United States Patent [19]

Hansel

[11] 4,253,490

[45] Mar. 3, 1981

[54] VORTEX ELIMINATOR

[75] Inventor: William B. Hansel, Media, Pa.

[73] Assignee: Sun Petroleum Products Company, Philadelphia, Pa.

[21] Appl. No.: 23,798

[22] Filed: Mar. 26, 1979

[51] Int. Cl.[3] ..... E21F 17/16

[52] U.S. Cl. ..... 137/590; 222/464; 222/564

[58] Field of Search ..... 137/172, 584, 587, 590; 222/464, 564

[56] References Cited

U.S. PATENT DOCUMENTS

| | | | |
|---|---|---|---|
| 2,996,073 | 8/1961 | Wolsh | 137/172 |
| 3,631,880 | 1/1972 | Hansel | 137/172 |
| 3,636,976 | 1/1972 | Hansel | 137/590 |
| 3,946,758 | 3/1976 | Hansel | 137/590 |
| 4,107,052 | 8/1978 | Yoshino et al. | 137/172 |

*Primary Examiner*—William R. Cline
*Assistant Examiner*—H. Jay Spiegel
*Attorney, Agent, or Firm*—J. Edward Hess; Donald R. Johnson; Paul Lipsitz

[57] ABSTRACT

In combination, a subterranean liquid storage tank, a pump suction pipe mounted therein and extending substantially vertically from the top of the tank toward the bottom thereof, and a disc member positioned below and in vertical alignment with the lower end of said pipe, the member having a pedestal which rests at the bottom of the storage tank, both the disc and said pedestal being flexible and compressible to a size enabling insertion into and withdrawal from the tank by way of the pipe. Preferably the disc and its supporting member will be made of a flexible foam.

6 Claims, 10 Drawing Figures

VORTEX ELIMINATOR

This invention relates to a suction vortex eliminator useful in subterranean hydrocarbon liquid storage tanks, such as tanks used for the storage of liquid fuel (e.g. gasoline).

Normally, in a subterranean storage tank with which an above ground or surface discharge pump is used, the suction for such pump is obtained by means of a suction pipe (suction stub) mounted vertically in the tank. The bottom open end of this pipe may be cut off at an angle to the vertical of say 45°. The lowermost portion of this pipe would be located at a small distance (e.g. 2 inches) above the tank bottom. Water (produced, for example, as a result of condensation within the tank) collects in the form of a layer on the tank bottom, since it is heavier than the hydrocarbon fuel being stored in the tank.

With this arrangement, it is possible to suck up water from the tank bottom when the end of the suction stub is about 2½ inches or less above the fuel-water interface. This mixing of water with the fuel being pumped is quite undesirable.

To avoid this result, the bottom ends of many suction stubs have been cut off. However, when this is done the tank cannot be pumped down, and the effective storage capacity of the tank is reduced.

A method of avoiding the pumping of water is described in my U.S. Pat. No. 3,636,976 which employs a bowl-shaped member positioned below and in vertical alignment with the lower open end of the suction pipe of the storage tank. The bowl-shaped member is collapsible to fit within the suction stub of the tank, and is inserted down through the check valve and the suction stub, into the tank. This member expands after leaving the suction stub at the tank bottom to assume the shape of a bowl or an inverted umbrella, forming a sump directly under the lower end of the suction stub. The cross-sectional area at the top of the sump is large as compared to the cross-sectional area of the suction stub or pipe.

The collapsible bowl-shaped member suffers from several disadvantages. The member is made of an elastomer material and is somewhat difficult and costly to manufacture. Also, the elastomer material tends to tear and crack during insertion and withdrawal from the suction pipe and thus the service life of the device is limited.

The present invention is an improvement on the bowl-shaped member of U.S. Pat. No. 3,636,976 and provides a system of lower cost and longer service life. In accord with the invention, the bowl-shaped member is replaced by a device comprising a disc-member to the bottom of which is attached a pedestal supporting member which rests at the bottom of the storage tank, the disc and its supporting member both being flexible and compressable so that the device is able to be inserted into and withdrawn from the suction pipe of the tank.

A detailed description of the invention follows, taken in conjunction with the accompanying drawings, wherein.

Figure 4:
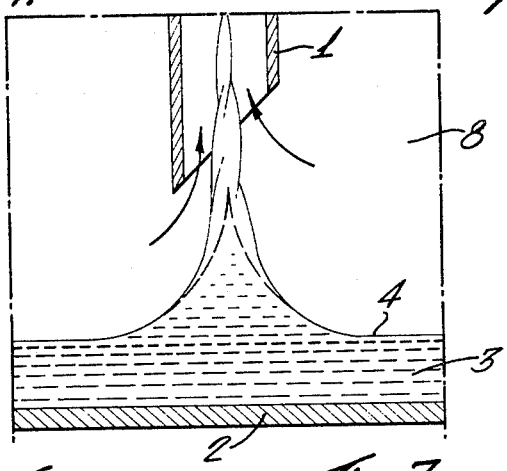
FIG. 4 is a schematic illustration showing the action that occurs, during pumping, at the bottom end of a conventional suction stub.
Figure 5:
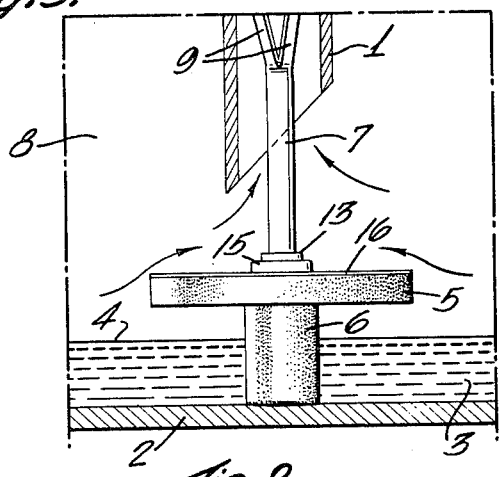
FIG. 5 is a schematic illustration showing the device in operating position and the action occurring, during pumping, at the bottom end of a suction stub when utilizing the vortex eliminator of the invention.

Referring now to FIG. 4 it is seen that when pumping from a conventional storage tank the suction at the bottom of the suction stub causes a vortex to form which sucks up water from the bottom of the tank into the hydrocarbon stream being pumped out. In contrast, as shown in FIG. 5, the device of the invention when resting at the bottom of a storage tank, eliminates the vortex and allows only hydrocarbon to be withdrawn from the tank.

Figure 1:
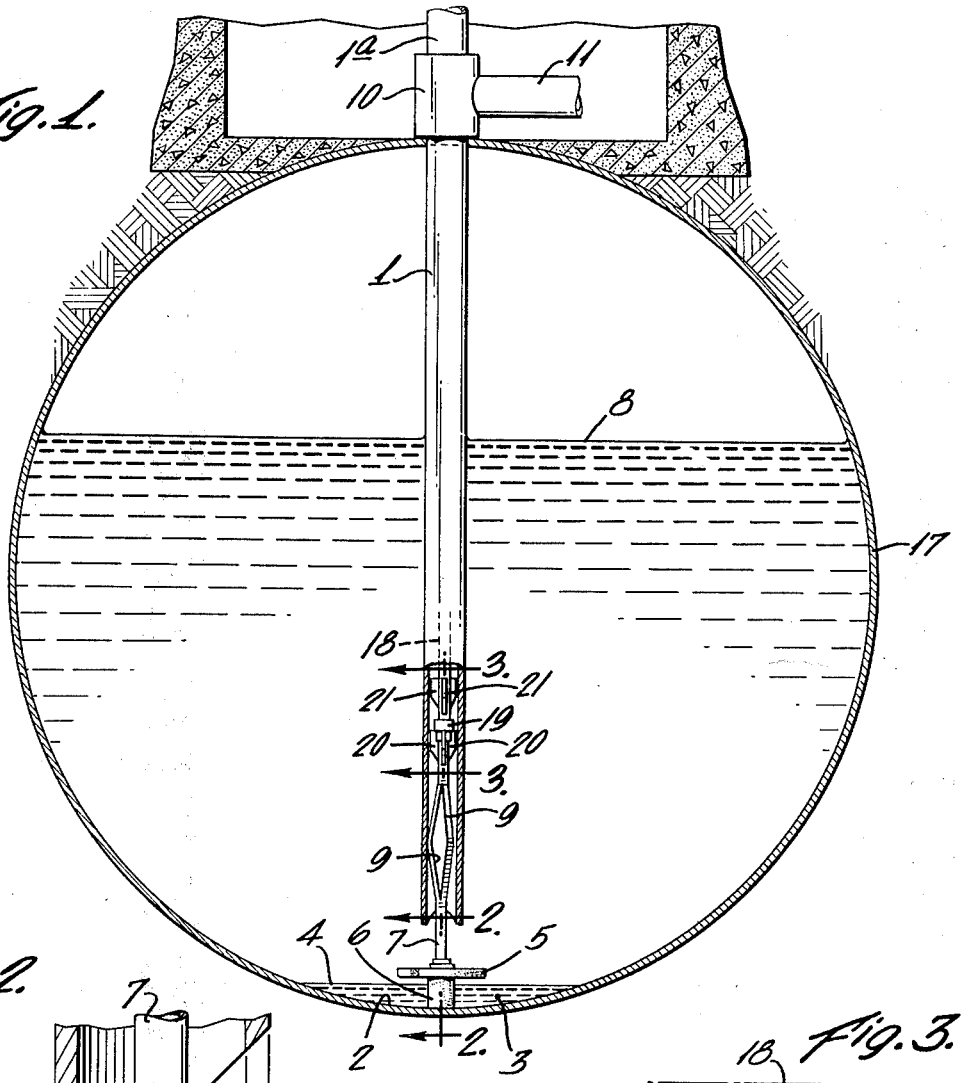
FIG. 1 is a view of the interior of a subterranean liquid fuel storage tank showing the device of the invention in its operating position.

FIG. 1 shows the device of the invention in its operating position, in a subterranean hydrocarbon liquid (fuel) tank. A subterranean fuel (e.g. gasoline) storage tank 17 is shown, this tank being, for example, cylindrical in outer configuration, with its longitudinal axis substantially horizontal. The water bottoms in the tank are indicated at 3, and the fuel-water interface at 4, the fuel level in the tank being indicated at 8. The vortex eliminator device comprises a disc 5 and pedestal 6 attached to a vertical hollow positioning rod 7 which is shown as cut vertically into three sections and splayed to make spring-like fingers 9 to provide support for the device by pressing against the inside circumference of suction pipe 1 through which fuel is pumped from the tank. A check valve 10 is located at the top of tank 17 outside the same, and the valve has a side outlet fitting II which is coupled to the suction or intake of an above-ground discharge pump (not shown), preferably of the positive-displacement-type. This pump ordinarily comprises part of a liquid fuel-dispening apparatus. Thus, fuel may be pumped from tank 17 through suction pipe 1 and check valve 10 to the fitting II, and thence to the intake of the discharge pump. The check valve 10 may be removed from its housing when desired, and when so removed straight through access may be had to suction stub 1 (inside tank 17) through the check valve housing, by way of an access pipe 1*a* which is reachable from the surface of the ground.

The member 5 is illustrated in FIG. 1 in its installed or operating (expanded) position, wherein its lower supporting member rests on the bottom 2 of the tank, member 5 being positioned below and in alignment with the suction stub 1, this member having the shape of a disc. Member 5 is maintained in this operating position by the supporting member 6 and by spring fingers 9 which engage the inside diameter of pipe 1. The spring fingers may be made from a piece of tubing with three longitudinal, essentially equidistant cuts and the sections splayed outwardly. Gasoline can flow upwardly through pipe 1 by way of the spaces between the individual spring fingers.

Figure 2:
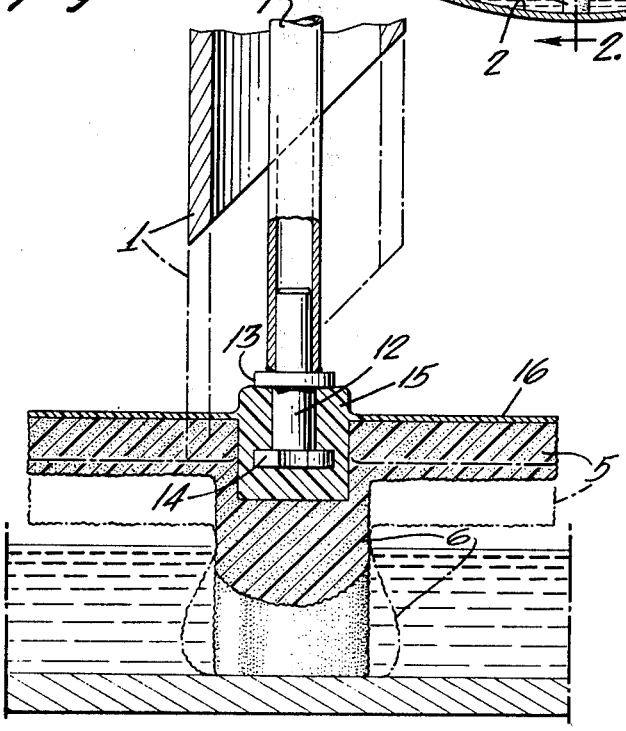
FIG. 2 is a schematic illustration showing the device in more detail.

FIG. 2 is an enlarged fragmentary elevation partly in section, taken on the line 2,2 of FIG. 1 showing details of the vortex eliminator device and a preferred means for it's construction. The vertical hollow positioning rod 7 has welded to it's lowermost end a stub shaft 12 having an upper flange 13 and lower flange 14, the lowermost flange is preferably serrated or irregular in shape to resist turning while threading the push and pull rod, when endeavoring to remove the vortex eliminator as later described. This stub shaft is embodied within a synthetic resin collar 15 having a thin, circular-extending, hydrocarbon liquid-impervious membrane 16 surrounding the collar. To the bottom of the membrane 16 is bonded a highly compressable circular disc 5 such as a flexible polyurethane foam, the disc also having a pedestal section 6, preferably of the same compressable material pending from the central portion of the disc. It will be understood that while a compressable foam is preferred for the disc and pedestal, other flexible and compressable materials may be used; e.g. rubber sponge, etc. Even a loose spring material may be used as the pedestal 6, but for ease of manufacture and economics a compressable foam will be used as illustrated. However, the top membrane surface of the disc 16 must be of a material which is impervious to flow of liquid through it. A solid coating of a flexible plastic material such as polyurethane, polyvinylchloride, and the like is satisfactory. Such coatings are easily sprayed, bonded, or otherwise applied to disc 5.

Figure 3:
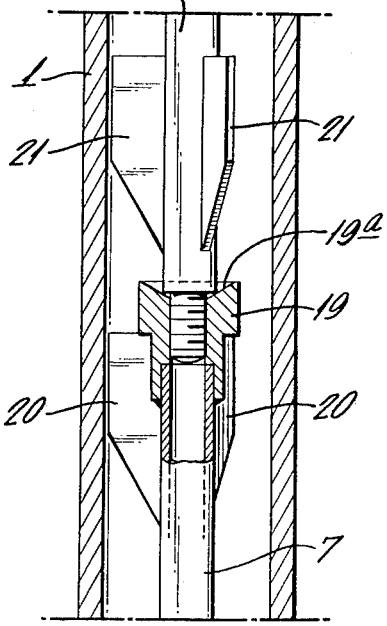
FIG. 3 is an enlarged, fragmented elevational view partly in section taken on line 3,3 of FIG. 1.
Figure 6:
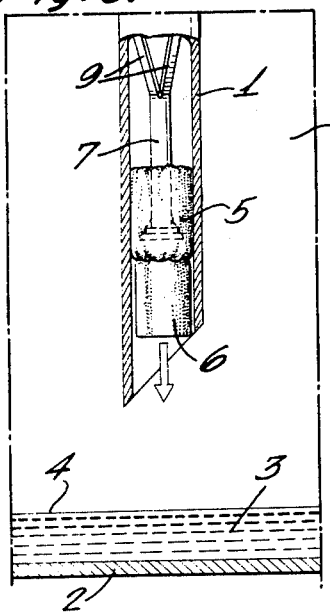
FIGS. 6, 7, 8, 9 and 10 are a series of views illustrating the respective stages or steps during the installation and removal of the device of this invention.
Figure 7:
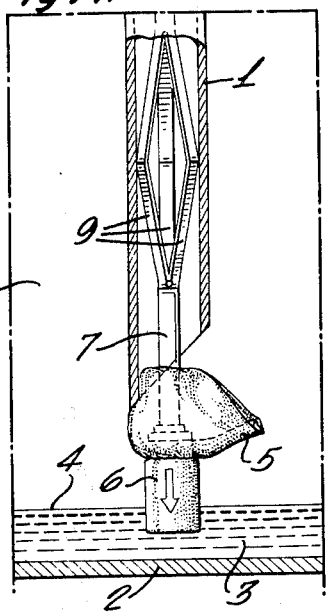
Figure 8:
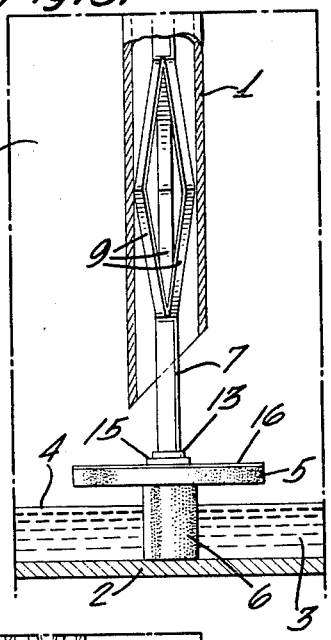

Reference is now made to FIG. 3 which is an enlarged fragmentary elevational view partly in section taken on the line 3,3 of FIG. 1. For inserting or removing the device, a rod 18 (FIG. 3), which extends upwardly to the surface through check valve 10 (which check valve is removed for purposes of insertion or withdrawal of disc member 5), is detachably secured at its lower end to the upper end of supporting rod 7, as by a threaded collar 19. FIG. 3 shows the lower end of the push and pull rod 18 in threaded engagement with the upper terminal end of the positioning rod 7, the upper end of the positioning rod having welded to it the threaded collar 19. The upper surface of collar 19 has a conical depression **19*a* for aiding in centering the threaded end of the "push and pull rod" into threading alignment. The upper end of the positioning rod optionally has welded to it three fins 20 that insure the centering its upper end. The lower end of the threaded push and pull rod may also be equipped with centering fins 21 if desired. For insertion of member 5 in the tank 17, rod 18 to which the device is attached is pushed downwardly to move the assembly 5, 6, 7, 9 and 19 down though the check valve 9 and suction stub 1, as illustrated in FIGS. 6, 7 and 8. The member 5 expands outwardly after leaving the lower end of the suction stub 1 at the tank bottom 2 (FIG. 7**).

In its fully expanded position, (FIG. 8) the device is in operative position, the disc member 5 being supported by the supporting pedestal 6 resting on the bottom of the tank while the disc itself is just below the opening of suction pipe 1.

Figure 9:
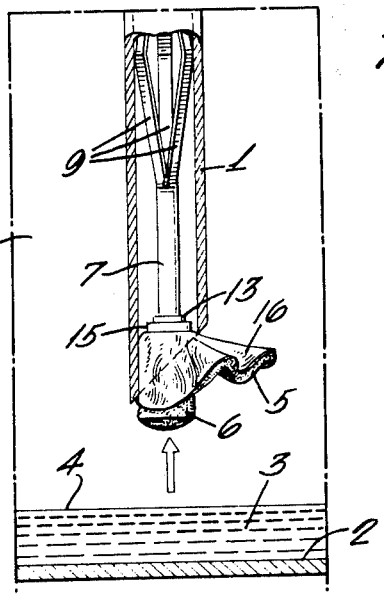
Figure 10:
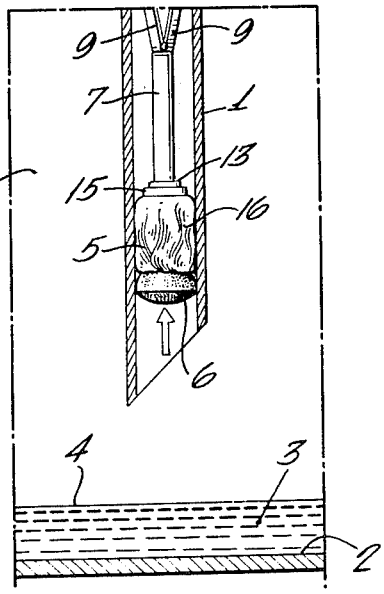

For withdrawal of member 5 from the tank, the above-described procedure is reversed. FIG. 9 shows how flexible disc 5 is deformed as it is being withdrawn upwardly through suction stub 1 and FIG. 10 shows the disc 5 and pedestal 6 totally within suction stub 1 during the withdrawal process.

During operation, friction between the spring fingers 9 and the inside wall of stub pipe 1 holds the device 5 in position below the lower end of the suction pipe. The device also is advantageously employed when the lower end of the stub pipe extends very close to the bottom of the tank as the pedestal 6 is also compressable. This situation is shown in dot and dash lines in FIG. 2 where it is clear that the device can still function properly since the compressable pedestal enables the device to be pushed through the stub pipe even though it is close to the bottom.

Although there has been illustrated a threaded coupling between the rod (inserting tool) 19 and the assembly 6, 12–18, various other forms of readily detachable couplings could be used in the alternative.

As indicated, the device is made of a flexible and collapsable material unaffected by hydrocarbon liquids, preferably a synthetic foam such as a polyurethane foam. The pedestal may, of course, be of any cross-section configuration, although a column for circular or square cross-section is easiest to make and is preferred. The pedestal 6 and disc 5 may be molded or the pedestal may be bonded to the disc either by an appropriate glue or by melting the surface of the pedestal, the disc, or both, and joining the melten surface to the other, whereupon an excellent bond will result on cooling.

The suction vortex eliminator of this invention prevents the pumping of water through the suction stub 1 when there is a water accumulation of 2.5 inches or less in the bottom of the tank (about 2.5 inches being the vertical height of member 5). Since the lowermost edge of stub or pipe 1 lies in approximately the horizontal plane of the upper open end of member 5, it should be apparent that when the fuel-water interface 4 rises to more than 2.5 inches above the tank bottom, some water will be pumped up through this pipe, even though the vortex has been eliminated. However, the use of the device permits extended times between removal from the tank of the accumulated water and thus helps to reduce costs of tank maintenance.

The invention claimed is:

1. A liquid storage system wherein a vortex which normally forms on withdrawal of liquid is eliminated which comprises in combination, a subterranean liquid storage tank, a pump suction pipe mounted therein extending substantially vertically from the top of the tank toward the bottom thereof, a disc member positioned below and in vertical alignment with the lower end of said pipe, said disc member being of a size larger in its top surface area than the cross-sectional area of said pipe and having a top impervious to flow of liquid through it, said disc member having a pedestal which rests at the bottom of the storage tank, said disc being flexible and compressable to a size enabling insertion into and withdrawal from the tank by way of the pipe and said pedestal being of a dimension fitting through said pipe or, if of a dimension which would not normally fit through said pipe being of a flexible and compressable material so as to enable insertion and withdrawal from the tank by way of said pipe together with said disc member.

2. The combination set out in claim 1, including means attached to said disc member and operable from outside said tank for moving said member to its extended, operating position and for withdrawing said member from the tank.

3. The combination of claim 2 wherein said disc and pedestal members are fitted with positioning means within said suction pipe to hold said members in alignment.

4. The combination of claim 3 wherein said disc and pedestal are made of a flexible foam.

5. The combination defined in claim 1 wherein the disc and pedestal are made of a flexible foam.

6. The combination of claim 5 wherein the foam is a polyurethane foam.

* * * * *